US009211043B2

(12) United States Patent
Kling

(10) Patent No.: US 9,211,043 B2
(45) Date of Patent: Dec. 15, 2015

(54) END PLUG FOR A PAPER ROLL

(75) Inventor: Robert Kling, Skene (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 840 days.

(21) Appl. No.: 13/001,788

(22) PCT Filed: Jul. 23, 2008

(86) PCT No.: PCT/SE2008/050886
§ 371 (c)(1),
(2), (4) Date: Dec. 29, 2010

(87) PCT Pub. No.: WO2010/011164
PCT Pub. Date: Jan. 28, 2010

(65) Prior Publication Data

US 2011/0114777 A1 May 19, 2011

(51) Int. Cl.
*B65H 75/18* (2006.01)
*A47K 10/40* (2006.01)
*A47K 10/32* (2006.01)

(52) U.S. Cl.
CPC ..... *A47K 10/40* (2013.01); *B65H 75/185* (2013.01); *A47K 2010/3206* (2013.01)

(58) Field of Classification Search
CPC ..... B65H 75/185; B65H 75/187; B65H 2301/412; B65H 2301/41346; B65H 2301/4134; B65H 16/06; A47K 10/40; A47K 2010/3206
USPC ..... 242/578, 578.2, 607, 609, 609.1, 609.2, 242/609.3, 613, 118.5, 596.7, 599, 599.4, 242/597.5, 597.6, 612, 599.2, 129.51
See application file for complete search history.

(56) References Cited

U.S. PATENT DOCUMENTS 3,145,451 A * 8/1964 Christensen ..... B05C 17/02 15/179
3,627,220 A * 12/1971 Vogel ..... 242/613.5
(Continued)

FOREIGN PATENT DOCUMENTS

CN 1411353 A 4/2003
CN 2937044 Y 8/2007
(Continued)

OTHER PUBLICATIONS

Chinese Office Action dated Apr. 3, 2013, issued by the State Intellectual Porperty Office of the People's Republic of China, in corresponding Chinese Patent Application No. 200880130471.7. (9 pages).
(Continued)

*Primary Examiner* — Sang Kim
*Assistant Examiner* — Nathaniel Adams
(74) *Attorney, Agent, or Firm* — Buchanan Ingersoll & Rooney PC

(57) ABSTRACT

An end plug to be inserted axially into the center of an end of a paper roll, and provided with a holding element for hold/guiding the end of the paper roll in correct position in a dispenser, the holding element being movable between a transport position, where the whole of the holding element is accommodated within the interior of an outer sleeve of the end plug, and an active position where a part of the holding element protrudes outwardly from an outer end of the outer sleeve, the outer sleeve includes a conical wall, whose base end defines the outer axial end of the outer sleeve, the holding element includes two opposite slide elements guided in diametrically opposite spoke elements projecting inwards in a radial direction in relation to the inner wall of the conical wall of the outer sleeve. The outer sleeve has such a shape that reaction forces acting on the outer sleeve when it is inserted into the center of an end of a paper roll are larger in at least two opposite regions thereof lacking inwardly projecting spoke elements than in regions from which spoke elements project inwards.

14 Claims, 3 Drawing Sheets

(56) References Cited

U.S. PATENT DOCUMENTS

| | | | | | |
|---|---|---|---|---|---|
| 3,840,194 | A * | 10/1974 | Vetter | B65H 75/185 242/609 |
| 4,032,077 | A | 6/1977 | Baselice | |
| 4,383,656 | A | 5/1983 | Campbell | |
| 4,834,312 | A * | 5/1989 | Riemenschneider, III | 242/588.2 |
| 5,292,083 | A | 3/1994 | Ridenour | |
| 5,322,234 | A | 6/1994 | Robert et al. | |
| 5,829,592 | A | 11/1998 | Henry, Jr. et al. | |
| 7,431,236 | B2 | 10/2008 | Larsson | |
| 2006/0226279 | A1* | 10/2006 | Paukov | 242/609 |
| 2010/0236956 | A1* | 9/2010 | Kling | A47K 10/40 206/391 |

FOREIGN PATENT DOCUMENTS

| | | | |
|---|---|---|---|
| EP | 1795479 | A1 | 6/2007 |
| EP | 1938727 | A2 | 7/2008 |
| FR | 2740125 | A1 | 4/1997 |
| GB | 2 243 822 | A | 11/1991 |
| GB | 2 362 375 | A | 11/2001 |
| RU | 2339565 | C2 | 11/2008 |
| WO | 99/12462 | A1 | 3/1999 |
| WO | 01/43613 | A1 | 6/2001 |
| WO | 2007/065686 | A2 | 6/2007 |
| WO | 2007/111561 | A1 | 10/2007 |

OTHER PUBLICATIONS

International Search Report, dated Mar. 31, 2009, from corresponding PCT application.

Chinese Second Office Action dated Nov. 20, 2013 issued by the State Intellectual Property Office of the People's Republic of China in corresponding Chinese Patent Application No. 200880130471.7 and English language translation (12 pages).

European Communication and Supplementary European Search Report dated Sep. 8, 2014 issued in the corresponding European Patent Application No. 08876631.6-1601 (9 pages).

* cited by examiner

END PLUG FOR A PAPER ROLL

TECHNICAL FIELD

The present invention relates to an end plug to be inserted axially into the centre of an end of a paper roll, and provided with a holding element adapted to hold and/or guide said end of said paper roll in correct position in a dispenser, said holding element being movable between a transport position, in which the whole of the holding element is accommodated within the interior of an outer sleeve of the end plug, and an active position, in which a part of the holding element protrudes outwardly from an outer end of the outer sleeve, the outer sleeve includes a conical wall, the base end of which defines the outer axial end of the outer sleeve, the holding element includes two opposite slide elements guided in diametrically opposite spoke elements projecting inwards in a radial direction in relation to the inner wall of the conical wall of the outer sleeve.

BACKGROUND OF THE INVENTION

Paper rolls for use in dispensers with automatic roll change are usually provided with end plugs having holding elements for guiding the roll to the different positions the roll have to reach in the dispenser during roll transfer. Furthermore, such holding elements also function to ensure a smooth unwinding of the paper on the roll. The holding elements protrude in use outside the opposite ends of the paper roll. The end plugs are often mounted by the manufacturer of the paper roll which means that the protruding holding elements of the end plugs makes it hard to effectively utilize available space for storing of paper rolls with end plugs and also for the storing of end plugs separate from paper rolls. It is known to solve this problem by making the holding element movable from a transport position inside the interior of an end plug and an active position in which a part of the holding element protrude outside the rest of the end plug.

Such an end plug being in accordance to the introductory paragraph is known from WO 2007/111561 A1. In this end plug the holding element rests in the transport position until moved therefrom by an external force. Thereby an end plug for paper rolls, which can be inserted into the ends thereof without intruding on available space for storing several of such paper rolls and which facilitates the forming of stable packages for piles of such rolls, is provided. Such an end plug can be used for paper rolls having a cylindrical core usually made of cardboard, around which the paper to be used, for example toilet paper, is winded, or for coreless paper rolls having a centre hole without a paper core. The end plugs also have to be cheap to manufacture since they usually are discarded after their first use. However, when such an end plug is used together with a paper roll having a cylindrical core or a coreless paper roll it is sometimes hard to move the holding element from transport position to active position due to frictional forces occurring between the slide elements and the spoke elements.

The objective of the invention is to solve this problem.

SUMMARY OF THE INVENTION

This objective is accomplished by an end plug to be inserted axially into the centre of an end of a paper roll, and provided with a holding element adapted to hold and/or guide said end of said paper roll in correct position in a dispenser, said holding element being movable between a transport position, in which the whole of the holding element is accommodated within the interior of an outer sleeve of the end plug, and an active position, in which a part of the holding element protrudes outwardly from an outer end of the outer sleeve, the outer sleeve includes an outer wall, the base end of which defines the outer axial end of the outer sleeve, the holding element includes two opposite slide elements guided in diametrically opposite spoke elements projecting inwards in a radial direction in relation to the inner wall of the outer wall of the outer sleeve, characterized in that the outer sleeve has such a shape that reaction forces acting on the outer sleeve when it is inserted into the centre of an end of a paper roll are larger in at least two opposite regions thereof lacking inwardly projecting spoke elements than in regions from which spoke elements project inwards. Thereby it is ensured that the largest external forces acting on the conical wall will act on wall parts not containing the spoke elements so that possible deformation of the outer sleeve due to external forces will be smallest in parts containing spoke elements.

In a preferred embodiment a number of axially directed fins project radially from the outer side of the conical wall around the circumference thereof, wherein at least two fins disposed on opposite sides of an axial plane passing through the spoke elements have a larger extension in a radial direction than fins being adjacent to the spoke elements. The largest radial extension from a longitudinal axis through the centre of the outer sleeve of fins having a larger extension than other fins is 0.5-10% larger than the largest radial extension from a longitudinal axis through the centre of the outer sleeve of said other fins. When the end plug is adapted to be used in a paper roll having a cylindrical paper core, the largest radial extension from a longitudinal axis through the centre of the outer sleeve of fins having a larger extension than other fins is 0.5-2% larger than the largest radial extension from a longitudinal axis through the centre of the outer sleeve of said other fins. When the end plug is adapted to be used in a coreless paper roll, the largest radial extension from a longitudinal axis through the centre of the outer sleeve of fins having a larger extension than other fins is 2.5-10% larger than the largest radial extension from a longitudinal axis through the centre of the outer sleeve of said other fins.

Each of the spoke elements consists of two axially directed walls radially extending inward from the inside of the conical wall, an outer end wall and an axial wall extending between said radially extending walls from the outer end wall in a direction towards the inner end of the sleeve, the two spoke elements being distanced from each other and located at the same distance from centre of the conical wall, whereby fins are disposed as prolongations of said radially extending walls, said fins having a smaller extension in a radial direction than the rest of the fins around the circumference of the sleeve. The walls and of the spoke elements, which are radially extending inward from the inside of the outer wall of the outer sleeve, form an angle of 20-45° to each other, preferably of 30-45°.

Preferably eight fins are arranged around the circumference of the sleeve equally spaced from each other, the fins being distanced from the spoke elements in a circumferential direction all having a larger extension in a radial direction than the fins associated with spoke elements. Furthermore, the fins having a larger radial extension than the other fins have their largest extension at about one third of the axial length of the sleeve from the outer end thereof.

The fins having a larger radial extension than the other fins can be provided with protrusions projecting radially therefrom and a circumferential rib can extend between each fin having a protrusion and an adjacent fin forming a prolongation of a radially extending wall of a spoke element.

The invention also relates to a paper roll provided with at an end plug as described above inserted into the centre of at least one of its ends. A paper roll provided with at an end plug described above and having fins inserted into the centre of at least one of its ends, the largest radial extension from a longitudinal axis through the centre of the outer sleeve of fins having a larger extension than other fins is 1-8% larger than radius of the centre hole in the paper roll.

BRIEF DESCRIPTION OF THE DRAWING

The invention will now be described with reference to the enclosed figures, of which.

DESCRIPTION OF EMBODIMENTS

Figure 1:
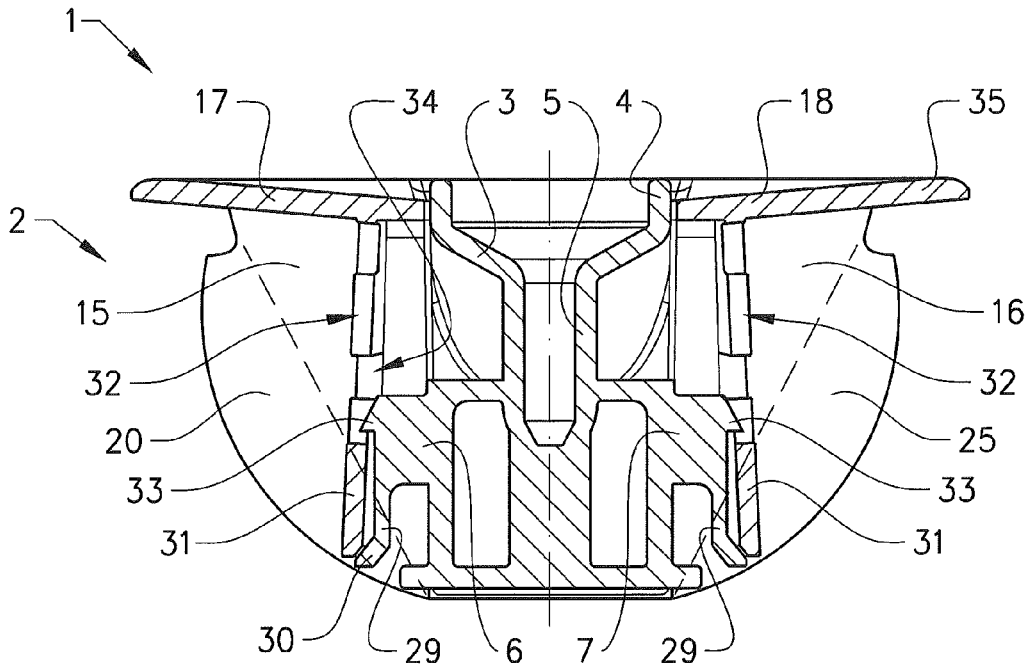
FIG. 1 shows a sectional view of an end plug according to a preferred embodiment with the holding element in a transport position.
Figure 2:
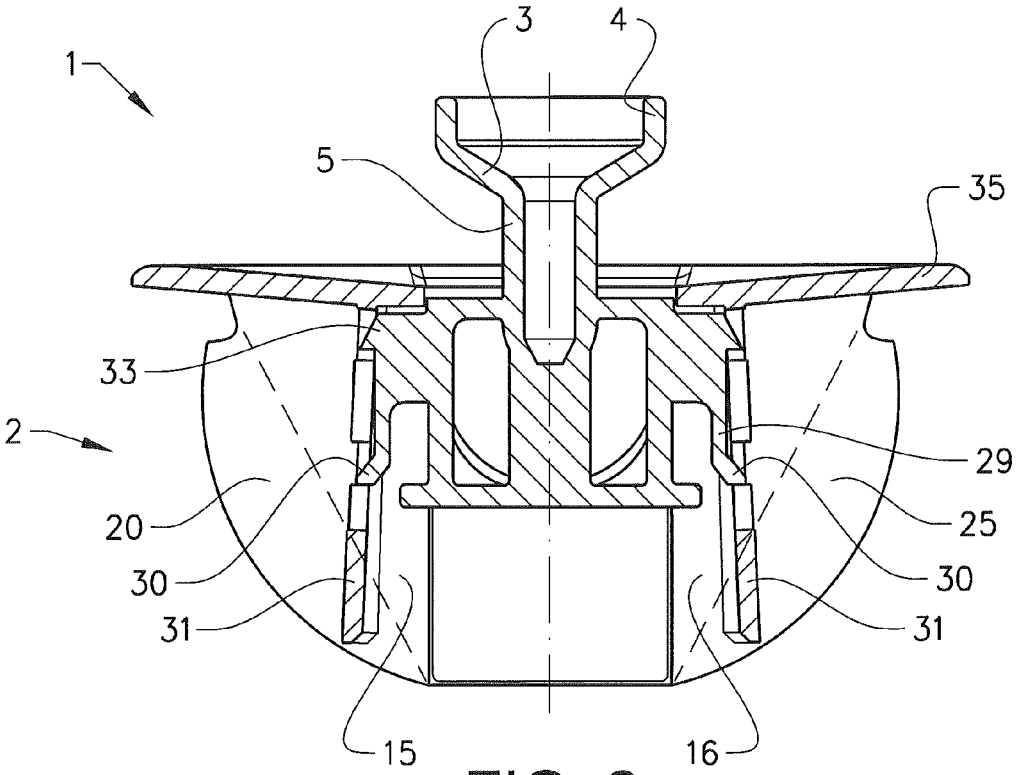
FIG. 2 shows a sectional view along line II-II in FIG. 4 of the end plug in FIG. 1 in a use position.
Figure 3:
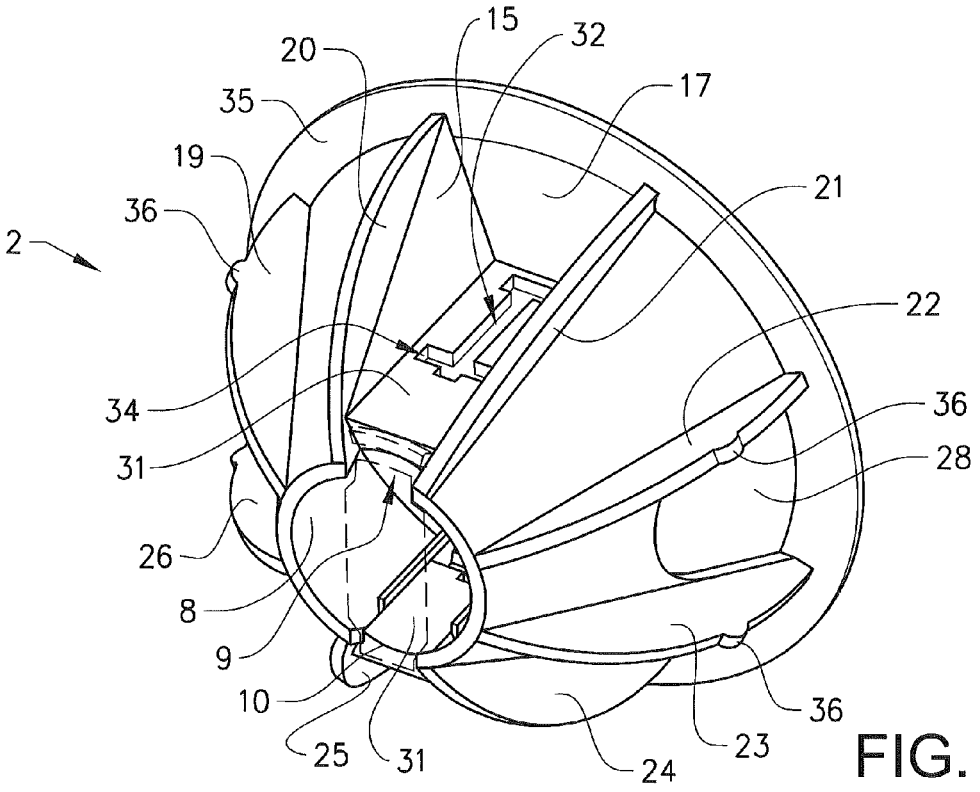
FIG. 3 shows a perspective view of the outer sleeve of the end plug in FIG. 1.
Figure 4:
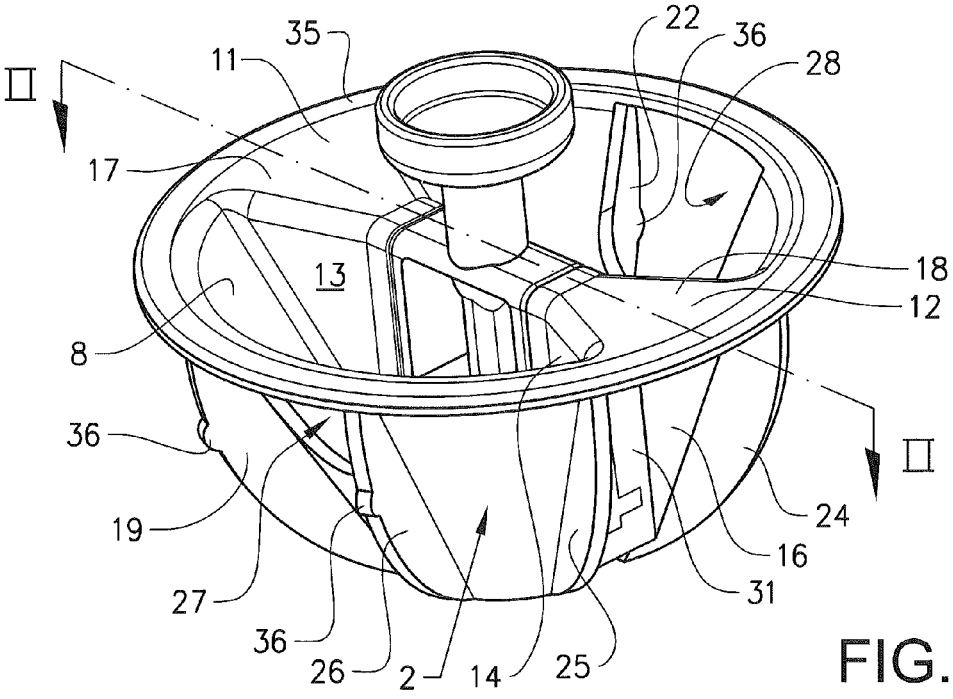
FIG. 4 shows a perspective view of the end plug in FIG. 2.

A first embodiment of an end plug 1 according to the present invention is shown in FIGS. 1-4. The end plug 1 comprises an outer sleeve 2 and a holding element 3 which is concentrically disposed in relation to the outer sleeve 2. The holding element 3 comprises a head 4, a stem 5 and slide elements 6, 7 extending sideways from the stem 5 in the lower half thereof. The slide elements 6,7 are slidable in the outer sleeve 2 to move the holding element 3 from a transport position shown in FIG. 1 to a active position shown in FIG. 2. For the sake of clarity, the outer sleeve 2 is in FIG. 3 shown without holding element 3. The outer sleeve 2 has a conical wall 8 extending from an outer end thereof to an inner end thereof having a smaller diameter. The outer end of the sleeve 2 is the end from which the head 4 and stem 5 of the holding element 3 project in the active position, as shown in FIG. 2. The conical wall 8 is interrupted at two diametrically opposite positions in order to let outer portions of the slide elements 6,7 pass in the openings 9,10 thereby created in the wall 8. In order to guide these portions of the slide elements 6,7, spoke elements 11,12 including walls having inner edges directed in the axial direction, i.e. the direction of movement of the holding element 3, are extending inward in a radial direction from all side edges, i.e. the edges running from one end to the other end of the outer sleeve 2, of the openings 9,10 in the conical wall 8. In FIG. 4 three such radially extending walls 13,14,16 are visible and in FIG. 3 one such wall 15 is visible. As can be seen by FIGS. 3 and 4 the radially extending walls 13-16 have a triangular shape. The edges of the triangular walls on both sides of the respective opening 9,10 are in the outer end of the sleeve 2 connected to each other by a respective top wall 17,18. The outer sleeve 2 also comprises fins 19-26 radially extending outwards from the conical wall 8, said fins being equally spaced from each other in the circumferential direction. Moreover, cut-outs 27,28 are made in the conical wall 8 at two diametrically opposite locations, an imaginary line between said locations being perpendicular to an imaginary line between the openings 9 and 10. These cut-outs facilitate inserting of fingers into the interior of the outer sleeve when the holding element is to manually be moved from a transport position to an active position.

In the cross-sectional views of FIGS. 1 and 2, which are cross-sectional views along line II-II of FIG. 4, the triangular walls guiding the movement of the holding element 3 are not visible. In order to facilitate understanding of the embodiment according to FIGS. 1-4, the border lines between triangular walls 15 and 16 and the respective fin 20,25 are shown with dashed lines in these figures. As can be seen in these Figures, the slide elements 6,7 have outer parts that project into the space between the respective pair of triangular walls 13,15 and 14,16. The contour of the underside of the holding element 3 is also shown with dashed lines in FIG. 3. The holding element 3 is thus guided by the respective pairs of triangular walls when moved from the transport position shown in FIG. 1 to the active position shown in FIGS. 2 and 4. A resilient tongue 29 with a turned out tip 30 is extended from outer side of each slide element 6,7 towards the inner end of the end plug 1. The outer end of the respective tip 30 is in the transport position shown in FIG. 1 located axially and radially outside an axially directed wall 31 extending between each pair of triangular walls 13,15 and 14,16 at a distance from the inner edges of the triangular wall corresponding to the distance at which the slide elements 6,7 project into the space between the respective pair of triangular walls 13,15 and 14,16. The walls 31 also have an axially extending slot 32 co-operating with a protrusion 33 on outer side of the respective slide element. Moreover, a slot 34 transversely directed to the axial direction of slot 32 is also present in each wall 31. An outwardly directed flange 35 extend around the circumference of the outer sleeve 2 and abut against an end of a paper roll when the end plug is inserted in the centre thereof.

The end plug 1 functions in the following way.

When the end plug 1 is manufactured the holding element 3 is inserted into the outer sleeve 2 from the inner end thereof until the holding element reaches the transport position shown in FIG. 1. During the insertion the protrusions 33 on the slide elements will press against the walls 31 until the inner end of axial slots 32 are reached. When this happens, the protrusions will pop into the slots and the tips 30 of the resilient tongues 29 will abut the inner end of walls 31. The protrusions 33 will then resist axial movement of the holding element 3 in a direction opposite to the insertion direction due to the saw tooth shape of the protrusions. There is thus no risk that the holding element 3 will accidentally fall out of the outer sleeve 2 after insertion and a stable transport position is obtained.

When the holding element 3 shall be moved into active position, this is simply done by gripping the head 4 and pulling out the portion of stem 5 not containing the slide elements from the outer sleeve 2. This movement should only be resisted by the force needed to bend the resilient tongues 29 and the friction created when the tips 30 by the resiliency of the tongues press against walls 31 during the movement of the holding element 3. During the movement of the holding element 3, the protrusions 33 are guided in slots 32, thereby ensuring a purely axial movement of the holding element. When the tips 30 of the tongues 29 reach the transverse slots 34, the tips will spring back to an unloaded position and into slots 34 thereby preventing movement of the holding element 3 from the active position back to the transport position. At the same time, the outer sides of the slide elements 6,7 will abut the inner sides of top walls 17,18 of the spoke elements 11,12 and thereby prevent further movement of the holding element 3 out of the outer sleeve 2. The holding element will thus be positively held in its active position when brought thereto.

The end plug 1 is dimensioned to fit tightly in the end of a core of a paper roll. The fins of the outer sleeve 2 of the end plug will be pressed against the inner wall of such a core and the reaction forces from the core will be directed radially towards the centre of the end plug. This might in some cases lead to a slight deformation of the end plug so that the spoke elements 11,12 will be displaced towards each other which in turn will increase the frictional forces between the spoke elements, i.e. the walls 31 thereof, and the slide elements 6,7 of the holding element 3. According to the invention, this problem is solved by providing some of the fins with a larger radial extension than other fins, thereby controlling possible deformation of the end plug in such a way that the largest reaction forces will act on other parts of the end plug than the parts where the spoke elements are located.

Accordingly fins 19, 22,23 and 26 are provided with protrusions 36 radially extending from the point of largest extension of said fins, the fins 20,21 and 24,25 radially extending from the respective spoke elements 11,12 being without such protrusions. When an end plug 1 is pressed into the end of a core of a paper roll, the highest reaction forces will then act on the fins 19,22,23 and 26. These fins are present in regions of the end plug located on both sides of the spoke elements 11,12 and the highest reaction forces will thus have a tendency to press these regions closer to each other, the regions containing the spoke elements being subjected to lesser reaction forces. If a deformation of the end plug occurs, the cross-section of the end plug will be given a somewhat oval shape with the spoke elements located in the regions of the oval shaped end plug being farthest away from each other. By the provision of protrusions on fins 19,22,23 and 26 possible deformation of the end plug 1 can thus be controlled.

Figure 5:
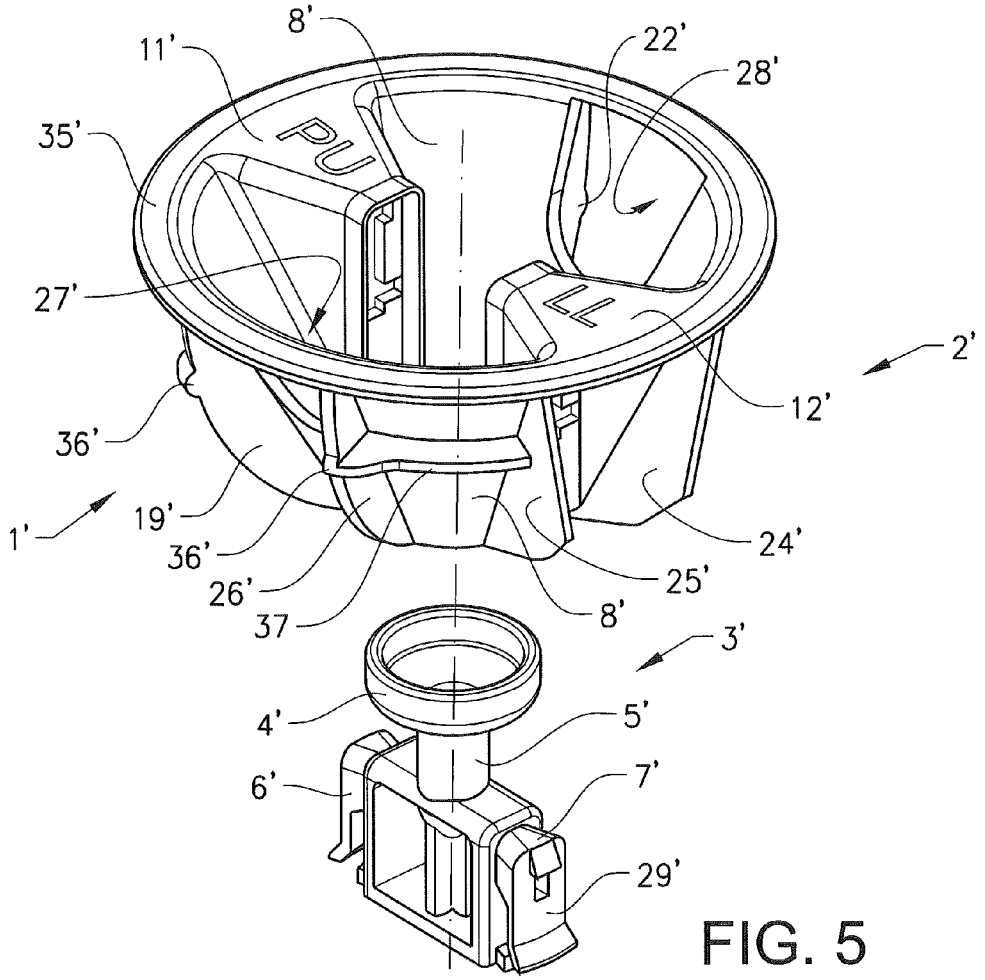
FIG. 5 shows a perspective view of an end plug according to a second preferred embodiment before inserting of the holding element into the outer sleeve.
Figure 6:
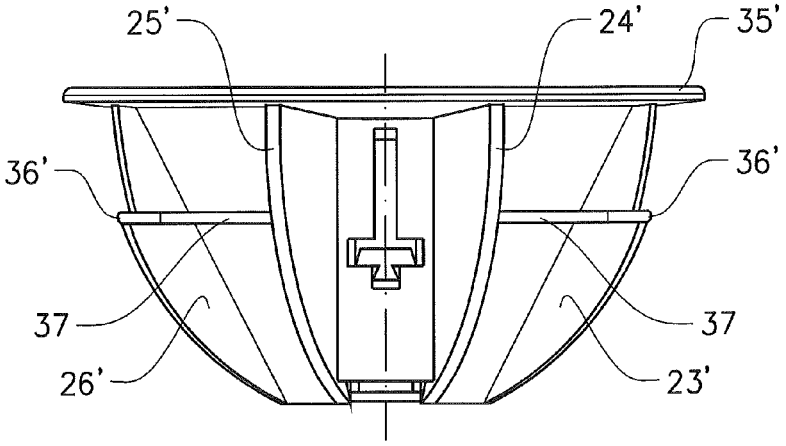
FIG. 6 shows a side view of the end plug in FIG. 5.

In FIGS. 5 and 6 a second embodiment of an end plug 1' is shown. The end plug 1' corresponds to the end plug 1 described with reference to FIGS. 1-4 except in one feature to be described later. Components of the end plug 1' corresponding to similar components of end plug 1 are given the same reference numerals with the addition of a prime sign and for the description and function of these components, the description of the first embodiment of an end plug made with reference to FIGS. 1-4 is referred to.

The only feature of end plug 1' differing from the features of end plug 1 is ribs 37 extending in a circumferential direction between fins adjacent to the openings 27' and 28' in the outer part of the conical wall 8' and the respective adjacent fin being a prolongation of the two triangular walls of spoke elements 11' and 12' at the level of the protrusions 36'. Such ribs 37 prevents the protrusions 36' and the fins provided with protrusion from moving sideways when subjected to reaction forces and makes the conical wall 8' locally more rigid. Thereby, the regions of the end plug containing the openings 27', 28' will be easier to deform than the regions containing the ribs 37 which will increase the tendency of the annular to deform to the desired oval shape when subjected to reaction forces from inner surface of a paper roll.

The radial extension of the protrusions 36,36' is between 0.05-2 mm, preferably 0.1-0.2 mm for paper rolls having a cylindrical core and preferably 1-1.5 mm for coreless paper rolls. Thereby it is ensured that the slide elements 6,7,6',7' will function in the described way even if the end plug is deformed to an oval shape as described above.

In the shown embodiments the axial location of the largest radial extension of the fins and thereby the end plug is located at about one third of the axial length of the end plug from the outer end thereof when the holding element is in transport position.

The protrusions 36,36' preferably have a sawtooth configuration, thereby preventing withdrawal of an inserted end plug.

Suitable materials for end plugs according to the present invention are polypropylene (PP) or polyethylene (PE), but also other plastic materials can be used. Preferably, materials suitable for injection moulding are used.

The end plugs according to the invention are primarily intended to be used on rolls of tissue paper with a core, i.e. a paper cylinder around which the tissue paper is wound but could of course be used also on coreless paper rolls. The end plugs are often applied to such rolls by the manufacturer manually or by automatic means and thereby delivered to the customer in an applied state. The holding elements of the end plug are of course then left in the transport position.

It is to be noted that it is not suitable to package rolls with end plugs having holding elements projecting out from the ends of the rolls in bags, since there is a risk that the holding elements or the bag is damaged during handling and transport thereof. By the use of end plugs according to the present invention bags can be used instead of paper board boxes, bags being made of a cheaper material.

The holding elements of the end plugs are brought to the use position when the rolls of tissue paper are placed in dispensers for such rolls, either by the person filling the dispensers, i.e. manually, or by co-operation with means in the dispenser side wall for forcing the holding elements to a use position. Such means can be gripping elements, such as tongues or the like, that are disposed inward of the heads of the end plugs on a roll and which will guide these heads in an outward movement during the inserting of the roll to a use position.

Figure 7:
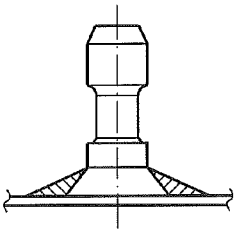
FIG. 7 shows a side view of a holding element in an active position.

The described embodiments of end plugs can of course be modified within the scope of invention. For example, the larger radial extension of certain fins need not be accomplished by protrusions but these fins can have a larger radial extensions as a whole. Furthermore, it is not needed that all fins in regions on both sides of the spoke elements are provided with protrusions although this is preferred, but it is enough that one fin in each of those regions is provided with a protrusion. Neither need the outer end of the holding element in the transport position lie flush with a plane through the plane of the outer end of the end plug but can lie inside such a plane. The head of the holding element need not have the shape shown in the figures but can have any suitable shape, for example the shape of a transverse rod, the shape of a X, etc, but should have rotational symmetry. An example of a suitable head is shown in FIG. 7. such a head is known from WO 2007/065686, to which is referred for further details. In certain applications, the head can be non-existent. The outer wall of the outer sleeve need not be conical even if this is preferred, at least for the inner end part thereof which is first to be inserted into a paper roll. The same consideration is valid for the fins. In some applications, the head of the holding element can be substituted by indentations or the like in the stem thereof.

The invention can also be applied to end plugs lacking fins. In such a case, protrusions can be applied directly to the outer sleeve in regions not containing spoke elements. It is also possible to give the outer sleeve a somewhat oval shape with the shortest diameter passing through the middle of the spoke elements. In this case, no protrusions are needed.

The end plugs can be used together with rolls in which two end plugs are needed to hold, and possibly guide, the roll in a dispenser. In some dispensers only one end of a roll need such a plug. The scope of invention shall therefore only be limited of the content of the enclosed patent claims.

The invention claimed is:

1. An end plug to be inserted axially into a centre of an end of a paper roll, and provided with a holding element adapted to hold and/or guide said end of said paper roll in correct position in a dispenser, said holding element being movable between a transport position, in which the whole of the holding element is accommodated within an interior of an outer sleeve of the end plug, and an active position, in which a part of the holding element protrudes outwardly from an outer end of the outer sleeve, the outer sleeve includes an outer wall having a base end which defines an outer axial end of the outer sleeve, the holding element includes two opposite slide elements guided in diametrically opposite spoke elements, each spoke element comprising at least two radially projecting side walls that extend inwards in relation to an inner side of the outer wall of the outer sleeve and that are connected with a top wall at the outer end of the outer sleeve from which the holding element protrudes, the top wall provided only in an area between the radially projecting side walls of each spoke element so that the top wall does not extend beyond the radially projecting side walls in a circumferential direction of the end plug, wherein the outer sleeve has a larger extension in at least two opposite regions of the outer sleeve other than in regions of the outer sleeve from which the two diametrically opposite spoke elements project inwards, each larger extension being fixed relative to the spoke elements when the holding element is moved between the transport position and the active position, such that reaction forces acting on the outer sleeve when said outer sleeve is inserted into the centre of an end of said paper roll are larger in the at least two opposite regions of the outer sleeve other than in the regions of the outer sleeve from which the two diametrically opposite spoke elements project inwards.

2. A paper roll provided with an end plug according to claim 1 inserted into the centre of at least one end of the paper roll.

3. The end plug according to claim 1, further comprising a number of axially directed fins projecting radially from the outer side of the outer wall of the outer sleeve around the circumference thereof, wherein at least two of the axially directed fins are disposed on opposite sides of an axial plane passing through the spoke elements, and have a larger radial extension than others of the axially directed fins that are adjacent to the spoke elements.

4. The end plug according to claim 3, adapted to be inserted in a paper roll having a cylindrical paper core, wherein the largest radial extension of the at least two of the axially directed fins having the larger extension is 0.5-2% larger than the largest radial extension of said others of the axially directed fins that are adjacent to the spoke elements.

5. The end plug according to claim 3, adapted to be inserted in a coreless paper roll, wherein the largest radial extension of the at least two of the axially directed fins having the larger extension is 2.5-10% larger than the largest radial extension of said others of the axially directed fins that are adjacent to the spoke elements.

6. The end plug according to claim 3, wherein a total of eight axially directed fins are arranged around the circumference of the outer sleeve and are equally spaced from each other, four of the axially directed fins having the larger extension and being distanced from the spoke elements in a circumferential direction, and the other four of the axially directed fins being the axially directed fins that are adjacent to the spoke elements.

7. The end plug according to claim 3, wherein the axially directed fins having the larger extension have their largest extension at about one third of the axial length of the outer sleeve from the outer end thereof.

8. The end plug according to claim 3, wherein the largest radial extension from a longitudinal axis through the centre of the outer sleeve of the at least two of the axially directed fins having the larger extension is 0.5-10% larger than the largest radial extension from a longitudinal axis through the centre of the outer sleeve of said others of the axially directed fins that are adjacent to the spoke elements.

9. A paper roll provided with an end plug according to claim 8 inserted into the centre of at least one end of the paper roll, wherein the largest radial extension of the axially directed fins having the larger extension is 1-8% larger than the radius of the centre hole in the paper roll.

10. The end plug according to claim 3, wherein the axially directed fins having the larger extension are each provided with a protrusion projecting radially therefrom.

11. The end plug according to claim 10, wherein a circumferential rib extends between each axially directed fin having a protrusion and an axially directed fin forming a prolongation of an radially projecting side wall of a spoke element.

12. The end plug according to claim 3, wherein each of the spoke elements further comprises: an axial wall extending between said radially projecting side walls from the top wall in a direction towards an inner end of the outer sleeve, the two spoke elements being distanced from each other and located at an equal distance from the outer wall, whereby the axially directed fins that are adjacent to the spoke elements are disposed as prolongations of said radially projecting side walls.

13. The end plug according to claim 12, wherein the radially projecting side walls of the spoke elements form an angle of 20°-45° relative to each other.

14. The end plug according to claim 13, wherein the radially projecting side walls of the spoke elements form an angle of 30°-45° relative to each other.

* * * * *